US009212859B1

(12) United States Patent
Tal et al.

(10) Patent No.: US 9,212,859 B1
(45) Date of Patent: Dec. 15, 2015

(54) SELF-RAISING MAGAZINE LOADER

(71) Applicants: Ran Tal, Tel Aviv (IL); Guy Tal, Rosh HaAyin (IL)

(72) Inventors: Ran Tal, Tel Aviv (IL); Guy Tal, Rosh HaAyin (IL)

(73) Assignee: Maglula, Ltd., Rosh Ha'Ayin (IL)

( * ) Notice: Subject to any disclaimer, the term of this patent is extended or adjusted under 35 U.S.C. 154(b) by 0 days.

(21) Appl. No.: 14/281,302

(22) Filed: May 19, 2014

Related U.S. Application Data

(60) Provisional application No. 61/826,767, filed on May 23, 2013.

(51) Int. Cl.
*F41A 9/83* (2006.01)
*F41A 9/82* (2006.01)

(52) U.S. Cl.
CPC ..... *F41A 9/83* (2013.01)

(58) Field of Classification Search
CPC ..... F41A 9/24; F41A 9/61; F41A 9/64; F41A 6/65; F41A 9/66; F41A 9/67; F41A 9/70; F41A 9/82; F41A 9/83; F41A 9/84
USPC ..... 42/87
See application file for complete search history.

(56) References Cited

U.S. PATENT DOCUMENTS 578,931 A * 3/1897 Johnson ..... 42/88
4,464,855 A 8/1984 Musgrave
4,570,371 A 2/1986 Mears
4,689,909 A * 9/1987 Howard ..... 42/87
4,706,402 A * 11/1987 Csongor ..... 42/87
4,719,715 A 1/1988 Howard
4,827,651 A * 5/1989 Conkey ..... 42/87
4,829,693 A 5/1989 Holmes
4,888,902 A 12/1989 Knowles
4,993,180 A * 2/1991 Upchurch ..... 42/87
5,249,386 A 10/1993 Switzer
5,355,606 A * 10/1994 Origoni ..... 42/87
5,377,436 A 1/1995 Switzer
6,178,683 B1 1/2001 Williams
6,189,254 B1 2/2001 Steitz
6,219,953 B1 4/2001 Bentley
6,286,243 B1 9/2001 Hinton
D477,047 S * 7/2003 Springer ..... D22/108

(Continued)

OTHER PUBLICATIONS

BlacksunTactical, "AA115 Promag Archangel Speed Loader for AA922 Nomad/Marauder Magazine", May 14, 2012, YouTube, <https://www.youtube.com/watch?v=ubUI-VGANKA>.*

(Continued)

*Primary Examiner* — Bret Hayes
*Assistant Examiner* — Derrick Morgan
(74) *Attorney, Agent, or Firm* — David Pressman

(57) ABSTRACT

A magazine loader (10) facilitates loading loose rounds into a firearm magazine. The loader comprises a body (12) with finger rests (14), a plunger tooth (18), a pusher element (20), and a spring (22). The body includes an opening (16) to accept the magazine. The tooth pushes down the topmost round (50). The pusher element and the spring push the loader up after each round is partially loaded. To load a round, the loader is fitted on the magazine and forced down so its tooth pushes the topmost round down sufficient to insert a new round, rim first, until it engages the plunger. Then, the user reduces force on the loader to allow the pusher to lift the loader up so that the plunger is cleared from the magazine, whereupon the partially inserted round can be forced rearwardly to its final position in the magazine.

11 Claims, 4 Drawing Sheets

(56) References Cited

U.S. PATENT DOCUMENTS

| | | | | |
|---|---|---|---|---|
| 6,817,134 | B2 * | 11/2004 | Newman | 42/87 |
| 7,257,919 | B1 * | 8/2007 | Farley | 42/87 |
| 7,383,657 | B2 | 6/2008 | Pikielny | |
| 7,487,613 | B2 | 2/2009 | Taylor | |
| 7,637,048 | B2 | 12/2009 | Tal et al. | |
| 8,065,830 | B2 | 11/2011 | Twardy | |
| 2007/0107291 | A1 * | 5/2007 | Tal et al. | 42/87 |
| 2013/0061505 | A1 | 3/2013 | Faifer | |
| 2014/0298704 | A1 * | 10/2014 | Niccum | 42/87 |

OTHER PUBLICATIONS

Archangel Manufacturing/Promag Industries "Archangel 10/22 Magazine Loader AA115", Sep. 10, 2012 South Gate, CA, USA. http://www.archangelmanufacturing.com/2012/09/10/aa115-archangel-1022-magazine-loader-black-polymer/. (Video clip at video clip at https://www.youtube.com/watch?v=ubUI-VGANKA).

* cited by examiner

SELF-RAISING MAGAZINE LOADER

CROSS-REFERENCE TO RELATED APPLICATION

This patent claims priority of our Provisional Patent Application Ser. No. 61/826,767, Filed 2013 May 23.

BACKGROUND

Prior Art

Small firearms, including pistols, assault rifles, and submachine guns, utilize and fire rounds (also known as cartridges and ammunition). Each round is substantially elongated and comprises a deep cylindrical cuplike case (also known as a shell casing and sometimes also a cartridge), usually of brass, which is filled with an explosive propellant. At its rear or closed end, the case has a rim or flange containing a primer; the front and opposite end of the case is open. A bullet, slug, or head, usually of lead (optionally jacketed) is partially inserted into the open or front end of the case, whereafter the case is crimped onto the bullet.

The rounds are usually held within and fed into the firearm from a magazine, also known as a clip. A detachable magazine has become dominant throughout the world. The term 'magazine' is broad, encompassing several geometric variations, including curved magazines. Most detachable magazines are similar, varying in form and structure, rather than in their general principles of operation.

Magazines usually take the form of an elongated boxlike container having a generally rectangular cross-section, which is attached to the underside of the firearm. Magazines are commonly made of aluminum alloys, plastic, steel, or a combination. They are usually closed on five sides and open on a sixth, upwardly facing, top, side, or end, and are substantially hollow. The top or open side has a rectangular end and includes two round-retaining members, known as feed lips. Magazines have an internal spring which urges a follower (blank shaped piece of plastic or metal) toward the open side. The follower in turn urges the rounds as a group up against the lips. The lips act as a stop for the rounds so that they are not expelled from the magazine.

Rounds are stacked or oriented in the magazine such that the longitudinal axes of the rounds are substantially parallel and perpendicular to the direction of travel of the spring and follower. Adjoining rounds are oriented side-by-side, i.e., the bullets of adjacent rounds are next to each other, as are the cases.

The rounds are usually stacked in the magazine, either in a single straight column (also called single-stacked) or in a staggered, zigzag, column fashion (also called double-stacked or high-capacity mags). The latter magazines, being wider, achieve higher round capacity compared to single-column magazines of the same overall length.

Commonly, in pistol magazines and in some submachine gun magazines, whether staggered or not, the space between the retaining lips is smaller than the case diameter of the rounds so that the two lips of the magazine hold the topmost round. Magazines of most assault rifles and submachine guns contain staggered rounds, and in contrast to the above pistol magazines, the topmost round is held in place by only a single lip. The latter (single-lipped) magazines are not relevant here.

Prior to use, a firearm magazine must be loaded (charged or filled) with rounds. When a magazine is being loaded, it is necessary to depress all previously loaded rounds to provide space below the lips so an additional round can be loaded inside. Each time another round is loaded the spring is further compressed, requiring more insertion force. When a magazine is fully loaded, the spring is fully compressed and exerts maximum upward force against the follower and rounds towards the lips.

Loading magazines is relatively time-consuming, tedious, and painful practice if done with bare fingers. Pain accumulates and intensifies as more rounds are loaded against the increasing spring pressure, thus slowing the loading process. When a user loads a plurality of magazines, much time is required, shortening reposing, training, or combat time. In combat circumstances, slow reloading can be life-threatening.

Straightforward bare finger loading of a magazine of the type having two lips retaining one round begins with the user placing a new round on top of the follower or an already loaded round in front of the lips. Then the user uses a thumb to force down the new round, and hence the round(s) below it, into the magazine sufficiently to make space below the lips to slide the new round rearwards below the lips to be retained by them. This procedure repeats until the magazine is full. Again, hereafter the term 'magazine' will mean magazines for ammunition which have two lips holding the topmost round.

To increase loading speed and decrease finger pain associated with loading magazines, numerous magazine loaders are known. Prior-art loaders are generally divided into two groups; loaders having no moving mechanism, which are the simplest and cheapest and least comfortable to use, and loaders having some moving mechanism which are usually better loaders.

Some relevant prior art loaders comprising no moving mechanism and a vertical round plunger are shown in the following patents:

TABLE 1

U.S. patents - Loaders With No Moving Mechanism And Vertical Plunger

| patent or Pub. Nr. | Kind Code | Issue or Pub. Date | Patentee or Applicant |
|---|---|---|---|
| 4,827,651 | B1 | 1989 May 9 | Conkey |
| 4,829,693 | B1 | 1989 May 16 | Holmes |
| 4,993,180 | B1 | 1991 Feb. 19 | Upchurch |
| 6,189,254 | B1 | 2001 Feb. 20 | Steitz |
| 6,219,953 | B1 | 2001 Apr. 24 | Bentley |
| 6,286,243 | B1 | 2001 Sep.11 | Hinton |
| D477,047 | S | 2003 Jul. 8 | Springer |
| 7,257,919 | B1 | 2007 Aug. 21 | Farley |
| 7,487,613 | B2 | 2009 Feb. 10 | Taylor |
| 8,065,830 | B2 | 2011 Nov. 29 | Twardy |

All the above loaders are not comfortable to use and are cumbersome, slow, and require several operator steps to load a round.

Relevant prior art loaders having some moving mechanism and a vertical round plunger are shown in the following patents:

TABLE 2

U.S. patents - Loaders With Moving Mechanism And Vertical Plunger

| patent or Pub. Nr. | Kind Code | Issue or Pub. Date | Patentee or Applicant |
|---|---|---|---|
| 4,570,371 | B1 | 1986 Feb. 18 | Mears |
| 4,689,909 | B1 | 1987 Sep. 1 | Howard |
| 4,719,715 | B1 | 1988 Jan. 19 | Howard |

TABLE 2-continued

| U.S. patents - Loaders With Moving Mechanism And Vertical Plunger | | | |
|---|---|---|---|
| patent or Pub. Nr. | Kind Code | Issue or Pub. Date | Patentee or Applicant |
| 4,888,902 | B1 | 1989 Dec. 26 | Knowles |
| 5,249,386 | B1 | 1993 Oct. 5 | Switzer |
| 5,355,606 | B1 | 1994 Oct. 18 | Origoni |
| 5,377,436 | B1 | 1995 Jan. 3 | Switzer |
| 6,178,683 | B1 | 2001 Jan. 30 | Williams |
| 6,817,134 | B2 | 2004 Nov. 16 | Newman |
| 7,383,657 | B2 | 2008 Jun. 10 | Pikielny |

Pikielny shows a spring-loaded thumb-operated loader. Newman shows a large and cumbersome spring-loaded lever-operated loader comprising many parts. Williams also shows a spring-loaded thumb-operated loader with an odd and unfriendly construction. Switzer also shows a large spring-loaded lever-operated loader comprising many parts. Origoni shows a spring-loaded thumb-operated loader comprising many parts. Switzer 386 also shows a large spring-loaded lever-operated loader comprising many parts. Knowles also shows a large spring-loaded lever-operated loader comprising many parts. Both Howard patents also show a spring-loaded thumb-operated loader. Mears also shows a spring-loaded lever-operated loader comprising many parts.

All the above loaders and Faifeer infra, who shows a large spring-loaded thumb-operated loader comprising many parts, use a vertical round plunger and are more advanced than the non-mechanism loaders described first above but are still relatively large, comprising several parts, and either thumb-operated or lever-operated.

TABLE 3

| U.S. Pub. patent applications - Advanced Loaders With Vertical Plunger | | | |
|---|---|---|---|
| patent or Pub. Nr. | Kind Code | Issue or Pub. Date | Patentee or Applicant |
| US2013/0061505 | A1 | 2013 Mar. 14 | Faifer |

Other prior-art loaders do not have a vertical plunger but rather a substantially horizontal plunger:

TABLE 4

| U.S. patents - Loaders With Horizontal Plunger | | | |
|---|---|---|---|
| patent or Pub. Nr. | Kind Code | Issue or Pub. Date | Patentee or Applicant |
| 4,464,855 | B1 | 1984 Aug. 14 | Musgrave |
| 7,637,048 | B2 | 2009 Dec. 29 | Tal et al. |

Musgrave shows a Z-shaped detachable loader that must be detached entirely from the magazine after each round is loaded and reinstalled back for the next round to be loaded. While it may facilitate loading, the necessity of attachment, sliding a new round in, and detachment makes its use inefficient, tedious, and awkward. It further lacks a structure which is comfortable for repeated use against the magazine's spring pressure, and is generally flimsy and delicate to use under field conditions.

Tal et al. show a popular universal magazine loader which we invented having a front metal plunger for pushing in the top-most round in the magazine, and a magazine aligner for aligning different magazines center in the loader behind the metal plunger. Loading a round involves moving the front plunger backward above the magazine and then forcing the loader down on the magazine to create a vacant space below the lips of the magazine so that a new round can be pushed down into the vacant space to its final position. This is an excellent and popular universal loader having a substantially horizontal plunger rather than a vertical plunger.

The following loader has a vertical plunger with additional issues:

Non-Patent Literature

ARCHANGEL MANUFACTURING/PROMAG INDUSTRIES, "Archangel 10/22 Magazine Loader AA115". 2012 Sep. 10, South Gate, Calif., USA. http://www.archangelmanufacturing.com/2012/09/10/aa115-archangel-1022-magazine-loader-black-polymer/. Video clip at video clip at https://www.youtube.com/watch?v=ubU1-VGANKA.

This Archangel loader comprises four parts: (1) a box-like main body with a top having a hole and an open bottom and an integral vertical round-pushing plunger, (2) a shaped magazine pusher positioned inside the body, (3) a compression spring for pushing the magazine pusher down, and (4) a bolt having a head above the top of the body and a shaft that passes through the hole in the top of the body down through the spring and with its bottom screwed into the magazine pusher, inside the body. The spring is held in position by the bolt that runs through it; its bottom end is captivated by the magazine pusher and its top end to the inside of the loader When the Archangel loader is positioned over a magazine and pushed down, the plunger pushes a round in the magazine down. Also as the body is pushed down, the magazine is supposed to push the magazine pusher and the bolt and hence the loader upward. However we have found that, prior to operation, the magazine pusher, the spring, and the bolt may easily and substantially move or wander sideways or rotate and thus may not operate reliably and accurately, causing the operation of the loader to fail because the magazine pusher will not engage the magazine properly. In addition, when each round is loaded in the magazine, the magazine pushes the magazine pusher—and hence the shaft of the bolt and its head—upward from the body and then back down. The user must keep their fingers clear of this bobbing bolt to avoid injury and interfering with operation of the loader during loading, and to avoid pinching when the bolt retracts back into the body of the loader. This loader also has a relatively large number of parts, which increases cost and creates less reliable operation.

In summary, some prior loaders for magazines are simple no-mechanism loaders that are relatively cheap but uncomfortable to use. Other prior loaders have more advanced mechanisms which are operated by a thumb, a lever, or by pushing down the entire loader. However the thumb-operated loaders cause thumb pain after short use, the lever-operated loaders are relatively large and comprise relatively many parts, and the push-down loaders may be unreliable or poorly designed. Lastly, while the Tal et al. loader comprises relatively many parts, it is most reliable and comfortable to use and sufficiently small.

ADVANTAGES

Accordingly, several advantages of one or more aspects are to provide (a) a method and mechanism for allowing low cost, pocket-size, lightweight loaders line comprising relatively few parts yet efficient and comfortable to use, (b) a loader that is not thumb operated, as such are difficult, slow, and painful to use, (c) a loader that is not lever-operated, as such are larger in size and comprise many parts, (d) a loader which reduces the number of operation a user has to load a round, (e) a loader which is workable at relatively high speed with minimal fatigue to a user's fingers, and where no force will be exerted on a single finger, (f) a durable loader that is simple to operate in tough, varying, conditions, (g) a loader that can also be used to unload rounds from the magazine. Further advantages of one or more aspects will become apparent from a consideration of the drawings and ensuing description.

SUMMARY

The present tool facilitates loading loose rounds, usually .22LR caliber and other small caliber rounds, into a firearm magazine. It basically comprises, in one aspect, three parts: a body with finger rests and a plunger tooth, a magazine pusher, and a spring. The body includes a rectangular opening sized to accept a magazine inside and two finger rests that extend from opposite sides of the body. A plunger tooth is positioned in the body above the rectangular opening and is sized to pass between the lips of the magazine to push down rounds in the magazine. The magazine pusher and the spring are arranged to lift up the loader after each round is loaded into the magazine. The pusher can be positioned adjacent the plunger and the spring is located between the pusher and the inner topmost part of the body. The dimensions of the rectangular opening are slightly larger than the cross-sectional dimensions of the magazine group for which the loader is made.

To load a round, the loader is inserted on the magazine and forced down so its plunger pushes the topmost round down into the magazine a sufficient distance to enable in a new round to be pushed in, rim first, until it meets the side of the plunger. Then the user reduces force on the loader to allow the spring-loaded pusher to lift and raise the loader up so that the plunger is cleared from the magazine and the partially inserted round can be forced further in to its final position in the magazine.

DRAWINGS

Figure 3A:
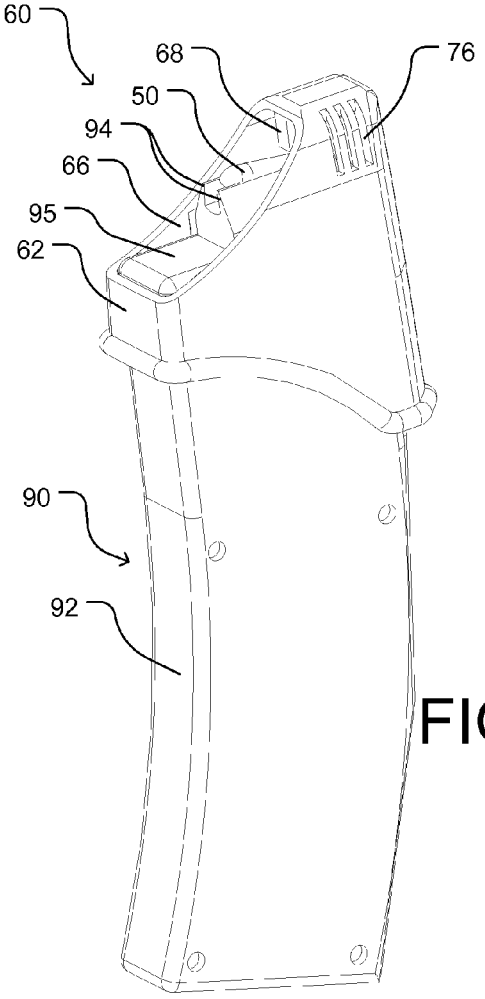
FIG. 3A is a perspective view of a first alternative loader on a matching magazine.
Figure 3B:
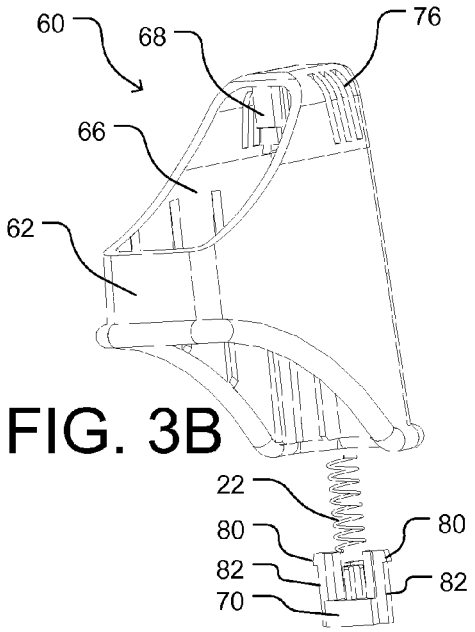
FIG. 3B is an exploded perspective view of the first alternative loader.
Figure 3D:
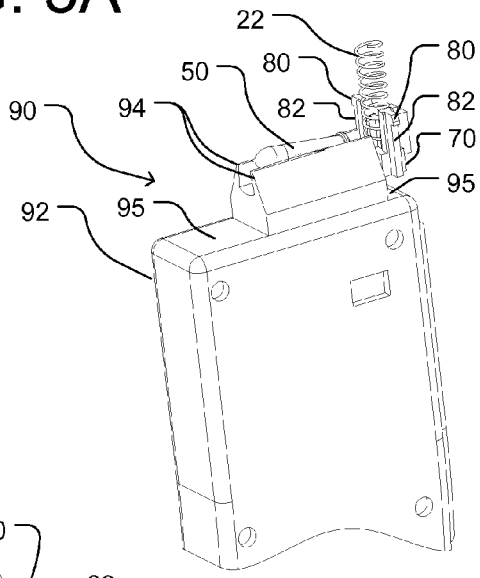
FIG. 3C is an exploded bottom perspective view of the first alternative loader.

FIG. 3D a perspective view of a portion of a magazine showing its upper ledge.

Figure 4A:
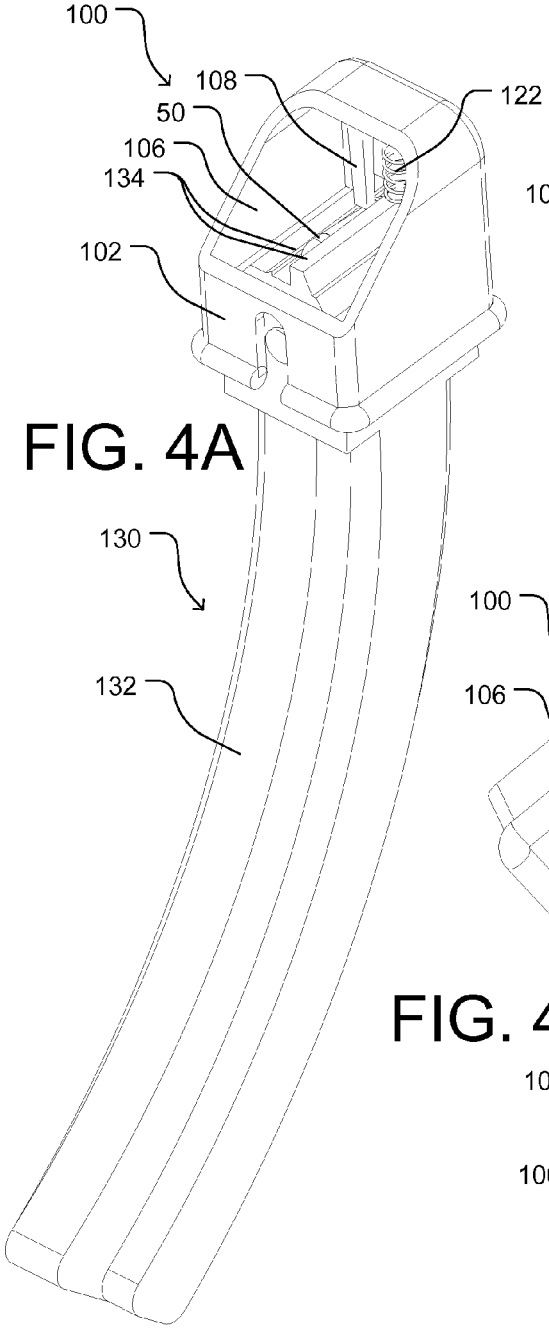

FIG. 4A is a perspective view of a second alternative loader on a matching magazine.

Figure 4B:
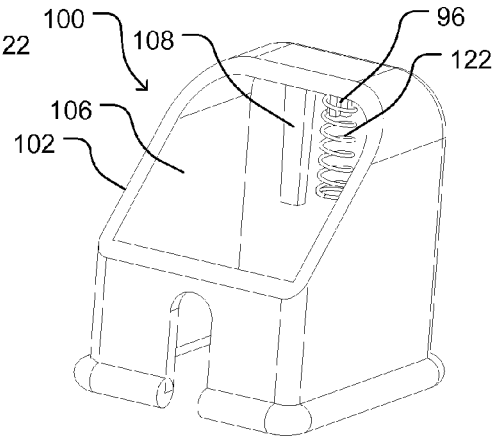

FIG. 4B is a perspective view of the second alternative loader.

Figure 4C:
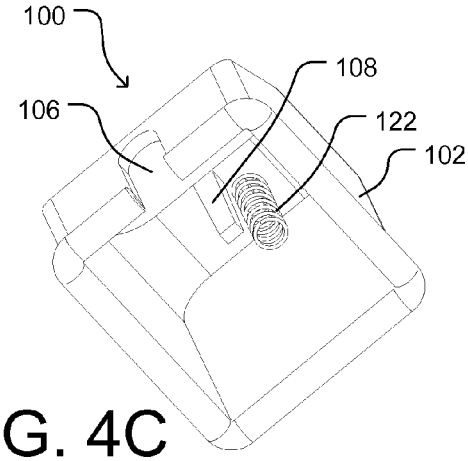

FIG. 4C is a perspective bottom view of the second alternative loader.

Figure 4D:
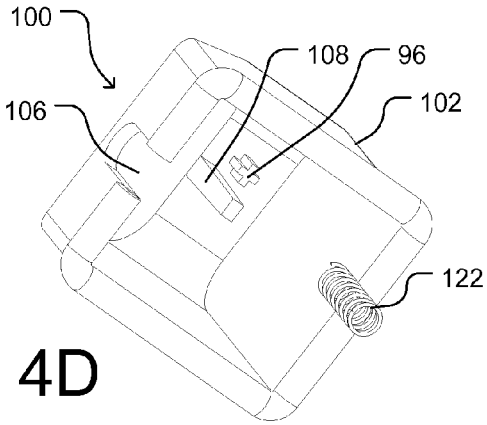

FIG. 4D is an exploded bottom perspective view of the second alternative loader.

REFERENCE NUMERALS

| | | | |
|---|---|---|---|
| 10 | loader | 12 | body |
| 14 | finger rests | 16 | chamber |
| 18 | plunger or tooth | 20 | magazine pusher element |
| 22 | spring | 24 | tower |
| 26 | slot | 28 | stop |
| 30 | pusher guide ribs | 32 | concave recess |
| 34 | unloading tooth | 36 | securing ring |
| 40 | magazine | 42 | body of magazine |
| 44 | lips of magazine | 46 | spring of magazine |
| 48 | follower | 50 | round(s) of ammunition |
| 50A | new round of ammunition | 60 | first alternative loader |
| 62 | body of first alternative loader | 66 | chamber |
| 68 | plunger tooth | 70 | magazine pusher element |
| 76 | slot | 76A | rear slot |
| 78 | stop | 80 | pusher stops |
| 82 | pusher guide ribs | 84 | spring positioner |
| 90 | first alternative magazine | 92 | body of magazine |
| 94 | lips of magazine | 95 | ledge of magazine |
| 96 | spring holder | 100 | second alternative loader |
| 102 | body of second alternative loader | 106 | chamber |
| 108 | plunger tooth | 122 | pusher spring |
| 130 | second alternative magazine | 132 | body of magazine |
| 134 | lips of magazine | | |

DETAILED DESCRIPTION

FIGS. 1A-2C—Pusher Engages Magazine Lips

Figure 1A:
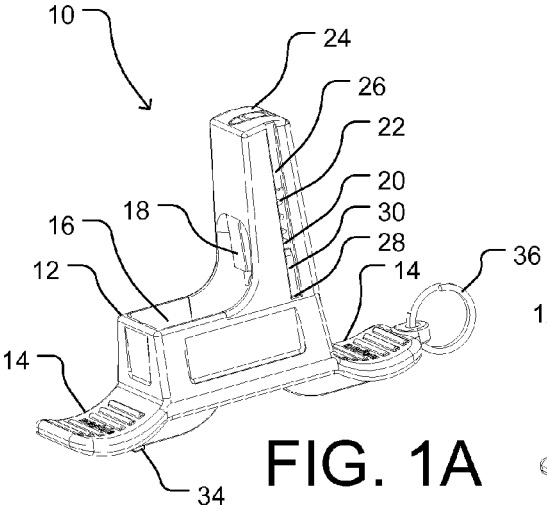
FIG. 1A is a perspective view of a new magazine loader shown with its pusher in a 'down' position.
Figure 2A:
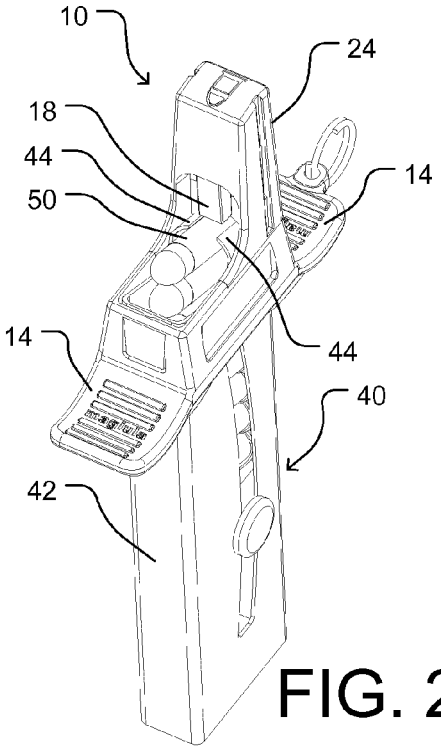
FIG. 2A is a perspective view of the loader in a neutral position on the magazine.
Figure 2B:
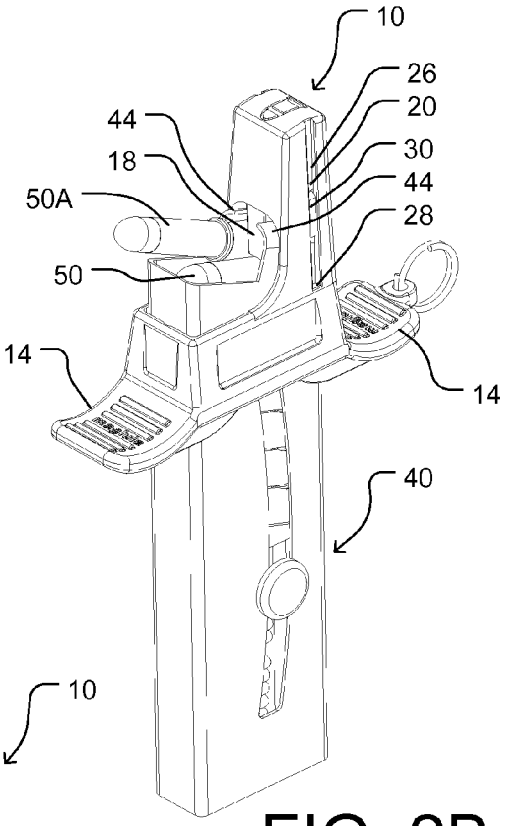
FIG. 2B is a perspective view of the loader forced down on and mated with the magazine.
Figure 2C:
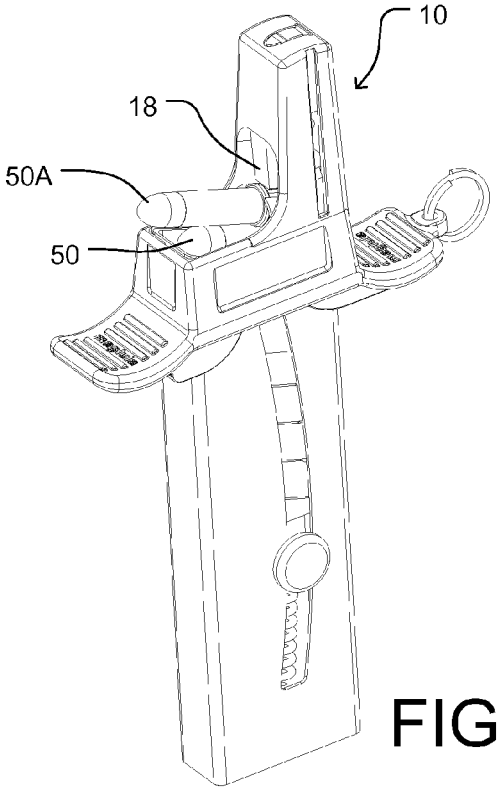
FIG. 2C is a perspective view of the loader with force released and the rim of the new round engaging the lips.

FIG. 1A is a perspective view of a first embodiment of our magazine loader 10 comprising three parts: a body 12 including a rounds or follower plunger or tooth 18, a magazine pusher element 20, and a spring 22. Body 12 also includes finger rests, grips, or lugs 14 extending from opposite front and rear sides of the bottom of the body, a tower 24 which contains plunger or tooth 18 that extends vertically downward from the tower, two pusher guide slots 26 vertically positioned on opposite right and left sides of the tower, and a substantially rectangular chamber 16 sized to accept a firearm magazine 40 (FIGS. 2A-2C). The dimensions of chamber 16 are slightly larger than the cross-sectional dimensions of the magazine onto which the loader fits.

Figure 1B:
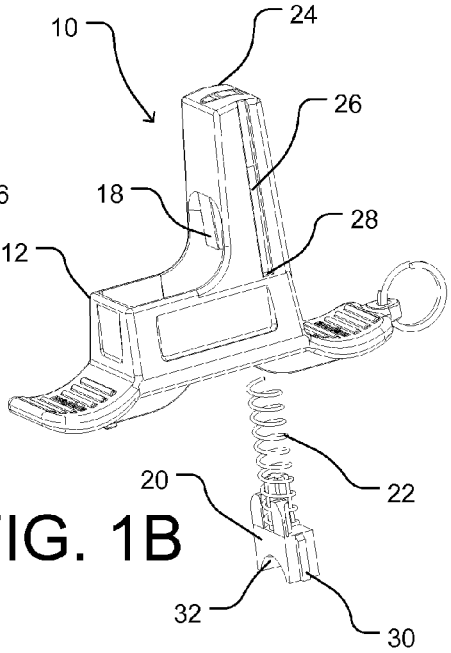
FIG. 1B is a perspective exploded view of the loader.

Plunger or tooth 18 (FIGS. 1A-1C) is positioned in tower 24 above cavity 16 and is sized to pass between lips 44 (FIG. 10) of the magazine. Tower 24 also houses magazine pusher element 20 and spring 22, which is a compression spring. Pusher element 20 is positioned to the rear of and parallel to plunger 18 and it has two side guide ribs 30, which mate with respective slots 26 of the tower. Pusher element 20 is free of rigid or fixed joinder to any component other than spring 22 but its two side guide ribs 30 are slidable in or guided by (but not rigidly or fixedly joined to) slots 26 of the tower so that it can move only in a straight vertical manner and is not rotatable. The top end of spring 22 is positioned against the inner topmost part of the tower's cavity and its bottom end is fitted onto an upwardly extending boss, not numbered, of pusher element 20 (FIG. 1B). The spring is housed in tower 20 so that it will not be able to rotate or move laterally during magazine loading.

A securing ring 36 on rear finger rest 14 enables a user to tie the loader to a belt loop, firearm, ammunition box, etc. to prevent loss.

The loader and pusher are preferably made of durable polymer material, as polyamide-6, produced by injection molding. The spring is preferably made of spring wire material. The magazine shown in FIGS. 1D to 2C is similar to a .22LR cal. Walther P22 magazine and the loader shown is designed to fit and load this model but can be adapted to other magazines.

FIG. 1B is a perspective exploded view of the loader showing body 12, pusher element 20, and its spring 22. Slots 26 of tower 24 have two respective small protrusions or stops 28 extending inward from the bottoms of the respective slots; ribs 30 engage respective stops 28 to block the pusher element from moving lower than the slots. The bottom side of the pusher element has a concave recess 32 sized and dimensioned to fit atop lips 44 of magazine 40 (FIG. 1D).

The loader is assembled by fitting the spring onto the pusher element and forcing both up into the bottom of the loader (spring first) and further upward in the cavity and slots of the tower until the pusher's ribs 30 pass and click over stops 28, whereupon the pusher is held in the loader.

Figure 1C:
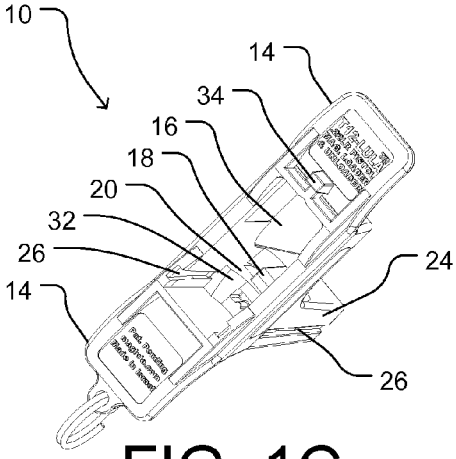
FIG. 1C is a perspective bottom view of the loader.

FIG. 1C is a perspective view of the underside of the loader showing an unloading tooth 34, slots 26, the underside of pusher 20 and its concave recess 32.

Figure 1D:
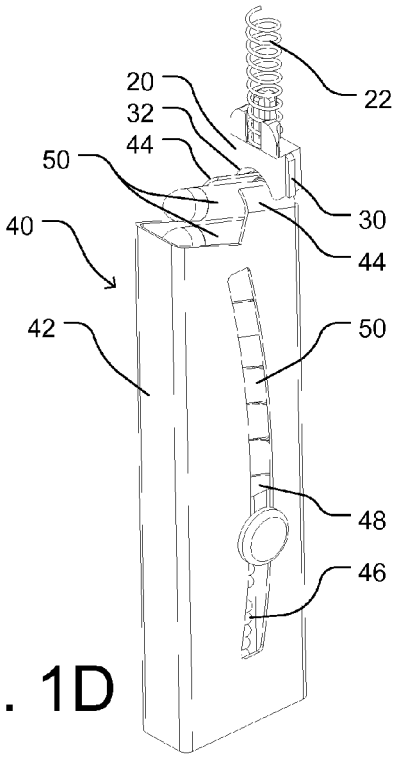
FIG. 1D is a perspective view of the pusher on top of a magazine.

FIG. 1D is a perspective view of magazine 40 and just spring 22 and pusher element 20 of the loader (body 12 is omitted). The pusher element is positioned on rear end of lips 44 of magazine 40; a round 50 is held between lips 44. The magazine is shown loaded with few rounds 50, and has a compressed magazine spring 46 and magazine follower or rounds pusher 48.

FIGS. 2A-2C—Perspective Views

FIG. 2A is a perspective view of the loader fitted and mated on magazine 40 in a neutral or unforced position where magazine pusher element 20 (FIG. 1D) mates with lips 44 of the magazine so that plunger 18 is centered between but spaced above lips 44 and above round 50, which is held by lips 44.

FIG. 2B is a perspective view of the loader being pressed by finger rests 14 further down onto magazine 40, causing several actions to occur: First, plunger 18 contacts and presses the topmost round down into the magazine, thus forming a vacant space below lips 44 and above the round that plunger 18 has pushed down. Second, lips 44 force pusher 20 upward inside the tower, compressing or tensioning spring 22 (FIG. 1D). A new round 50A is manually and partially inserted (user's fingers not shown), rearwardly or rim first, into the vacant space centered below lips 44 and above round 50. The user pushes it in further until its rear or rim contacts and is blocked from further insertion by plunger 18 (contact not shown).

FIG. 2C is a perspective view of the loader after the user releases pressure on finger rests 14, allowing pusher element 20 and spring 22 to raise the loader up so as to clear plunger 18 from between the lips to unblock and reveal the space below the magazine's lips. The loader is now fitted on magazine 40 in the neutral or unforced position. Round 50A can now be pushed rearwardly below plunger 18, the magazine's lips, and concave opening 32 (FIG. 1B) of pusher element 20 into its final place in the magazine.

Operation—FIGS. 1*a*-2*c*

To load a new round into the magazine the user completes the following operations: First the user fits the loader on the magazine in the neutral or unforced position. Then the user forces the finger rests down, thereby creating sufficient vacant space below the magazine's lips to partially insert a new round, rearwardly or rim first, into the partial vacant space. Then the user releases pressure on the finger rests to return the loader to the neutral or unforced position so that the user can push the round fully into the magazine.

To detail the above loading operation of a round into magazine 40 (FIG. 2A), the user first fits loader 10 on the magazine as shown with the tower at the rear side of the magazine. This is the neutral or unforced position.

The user then pushes finger rests 14 down (FIG. 2B) to force the loader down onto the magazine to a depressed position. Plunger 18 contacts the topmost round 50 (or the magazine follower if there are no rounds already in the magazine) and forces the round or follower down further. This creates a small space below magazine lips 44 and above the topmost round or magazine follower. The lips of the magazine will concurrently force pusher element 20 up higher in the loader, compressing spring 22 within the tower. While continuing to maintain pressure on finger rests 14 to hold the loader in the depressed condition, the user then effortlessly slides a new round 50A into this space until the rim of the round meets or hits plunger 18, thus completing the first stage of the loading.

Next, the user releases pressure on finger rests 14 of the loader, allowing compressed spring 22 in the loader to force the loader up to clear the plunger from between the lips and clear a larger vacant space below the lips and to the rear of the partially inserted round (FIG. 2C). The loader now is returned to the neutral or unforced position. The magazine's spring 46 and follower 48 force the partially inserted round 50A up against lips 44 so that round 50A holds all preloaded rounds below round 50A and the magazine follower from moving upward. Next, the user pushes the partially inserted round 50A backward into the vacant space behind round 50A and below the lips to its final home position as shown in FIG. 2A. Round 50A slides against the underside of lips 44 as it is pushed home but since it is partially inserted, only minimal effort is required to push it home.

The user repeats this loading process (force loader down, partially insert round, release pressure on finger rests, insert the round the rest of the way to final position) until the magazine is full. Then the user removes the loader.

Pusher element 20 and spring 22 provide a great benefit by making the loader self-raising loader when pressure on the finger rests is released, thus eliminating the need for the user to raise it manually. This allows the user, for example, to hold the magazine and loader in one hand—free from external support—while comfortably feeding rounds with the other hand. Loading is then quicker and smoother compared to virtually all prior-art loaders described above, excluding the one to Tal et al.

To unload rounds from the magazine, the user can sequentially and comfortably pushes the rim side of the rounds forward with small unloading tooth 34 shown in FIG. 1C, thereby expelling the rounds from beneath the lips. This is done by holding the magazine in one hand with the bullet side pointing substantially down, and holding the loader with the other hand and engaging tooth 34 with the rim of the topmost round-pushing it downward away from the magazine; and repeating. This is a good alternative to painfully forcing out rounds by the tip of the thumb.

The loader provides substantial assistance to a firearm user by enabling the user to safely, comfortably, and rapidly load a magazine without finger pain or injury. The loader is designed to be compatible with magazines for single-stacked .22LR caliber rounds. The range of magazines and round calibers may be extended or altered by changing the dimensions of the loader's parts and/or their arrangement. The loader can be altered under the methods and principles here described to load .25, .32, .380, 9 mm, 10 mm, .357, and .45 caliber magazine and others, though it is more comfortable to use with smaller caliber magazines and rounds. Alternately, such magazines can be loaded using the inventors' commercially popular and patented loaders, trademarked UpLULA and BabyUpLULA, briefly mentioned above.

Second Embodiment

FIGS. 3A-3D—Pusher Element Engages Ledge of Magazine

There are many magazines in the market holding a single-round between both lips as mentioned far above; each is somewhat different in geometry, construction, and dimensions. Some of those magazines have an upper ledge or shelf 95, as exemplarily shown in FIGS. 3A and 3D.

FIG. 3A is a perspective view of a first alternative loader 60 shown ready to load an AR15/M16 converted .22LR caliber magazine 90 having body 92, feed lips 94, and upper ledge 95. Loader 60 has also three parts—body, magazine pusher element, and spring. The loader has a magazine pusher element 70 (FIG. 3B-3D) that is adapted and designed to engage an existing rear ledge or shelf 95 of magazine 90, rather than its lips, for pushing the loader upward using the same principles of operation. While loader 60 is constructed slightly different from loader 10 described above, the method of loading and the principles of operation are similar.

Loader 60 has a body 62 with a chamber 66 and a round plunger or tooth 68. Loader 60 also includes a magazine pusher element 70 having guide ribs 82 with protruding pusher stops 80 at the upper end of the ribs as shown in the exploded view of FIG. 3B. Ribs 82 and pusher stops 80 are slidable in slide in slots 76 and thus element 70 is not rotatable. Pusher stops 80 engage stops 78 (FIG. 3C) when the pusher is down, keeping it from exiting the slots and loader. Spring 22 is positioned between pusher element 70 and the inner top side of body 62 and is similar to spring 22 of loader 10.

Figure 3C:
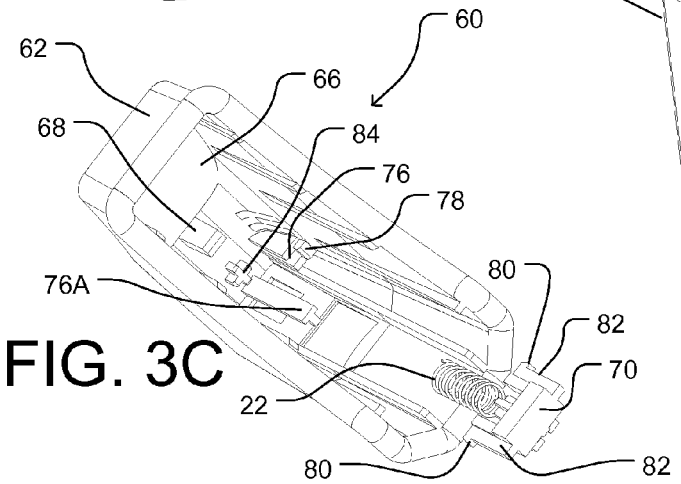

FIG. 3C is an exploded bottom perspective view of loader 60 showing body stop 78 and spring positioner 84, which positions the upper side of spring 22 in place; the positioner is slightly smaller than the inside diameter of the spring. Also a rear guide 76A guides pusher 70, which fits onto guide 76A as well as in slots 76.

FIG. 3D shows an upper portion of magazine 90 where pusher element 70 is shown at the rear of lips 94; element 70 engages and push on ledge 95 of the magazine. The magazine pusher is designed to correctly mate with a predetermined magazine.

Operation—Second Embodiment

FIGS. 3A-3D

The operation of loader 60 is similar to that of loader 10. The loader is self-raising once the user releases force on the loader. This eliminates the need to raise the loader up to clear tooth 68 from between lips 94 of the magazine. Since the loader body is relatively large, the user has a good grip on the loader for comfortable loading, using no finger rests.

Third Embodiment

FIGS. 4A-4D—Pusher Is Spring

FIGS. 4A to 4D are perspective views of a second alternative loader 100 comprising only two parts—a body and spring; no magazine pusher element is provided. Loader 100 is seen from various angles, with FIGS. 4A and 4B showing the loader from above and right and FIGS. 4C and 4D from below and front. The loader is shown, as an example, for loading high-capacity Ruger 10/22 .22LR style magazines 130 having a body 132 and feed lips 134. Loader 100 is slightly different from loaders 10 and 60 in that its spring serves to push the magazine directly. Thus the loader has two main parts, a body with a rounds tooth or plunger and a spring. The spring shown is a compression spring. The method of loading and principles of operation are similar. Loader 100 has a body 102 with a chamber 106 and a rounds plunger tooth 108. The loader has no pusher element (20 or 70 in FIGS. 1B and 3B). Instead the loader uses only a pusher spring 122 with two ends. The spring's upper end is securely attached or force-fit onto a boss, post, or stub 96 (FIG. 4B) that is slightly larger than the inside diameter of the spring and that extends down from the top inside of the loader so that the spring also extends down from the top inside. The spring's lower end is free. Spring 122 is similar to the springs described above and is designed here to engage a single (right) lip 134 of magazine 130 (FIG. 4A) with its free end, or engage ledge 95 if used in loader 60 of FIG. 3 to fit magazine 90, as an example. Body 102 has an upper end to which the post and the tooth or plunger and spring are affixed, a plurality of sides extending up from the bottom opening to the upper end. As shown in FIG. 4C, plunger tooth 108 is in front of and to the left of post 96 and spring 122 to enable the tooth to mate with a round and the spring to mate with lip 134 of the magazine.

The loader described operates on similar principles but may vary in form and shape according to the magazine it is designed to load. Thus, the elimination of the magazine pusher element is possible whenever a spring (one or more) can be designed to reliably engage the magazine (or its lips) and raise the loader as previously described.

Operation—FIGS. 4A-4D

The operation of loader 100 is similar to that of loaders 10 and 60 described above but here spring 122 engages a lip of the magazine directly. The loader is self-raising once the user releases force on the loader. This eliminates the need to raise the loader up to clear tooth 108 from between lips 134 of the magazine. The loader provides very comfortable loading.

CONCLUSION, RAMIFICATIONS, AND SCOPE

The reader will see that we have provided an efficient, palm-size, comfortable, and safe self-raising magazine loader comprising few parts that can load magazines without any finger pain associated with pushing the rounds with the thumb into the magazine.

While the above description contains much specificity, these should not be construed as limitation on the scope but rather as an exemplification of several embodiments thereof. Many other ramifications and variations are possible within the teachings. For example, the loaders described can be altered to fit other magazines and calibers provided a suitable change in dimensions and construction is made in the loader to suit a magazine. E.g., the loader can be altered to load other pistol magazines and other 10/22 style magazines sold under the trademarks RUGER, BLACK DOG, CMMG, S&W, COLT, SIG-SAUER, WALTHER, and other existing and future .22LR AR/M16-style converted magazines, as well as virtually most other magazines on the market holding a single round between and by the lips.

The following are further examples of some additional variations and ramifications:

The magazine pusher element, pusher lock mechanism, and the tower and slots may be altered. The loader can be used with most magazines having a projecting side button. Many other types of pushers and bodies can be designed for the loader, either to adapt to specific magazines, specific calibers, and to provide finger rests, or to include other features.

The loader body may comprise more than one parts adapted to fit on a specific magazine.

The loader and its components may be made of separate or different plastic materials, or, alternatively, of other materials, such as aluminum or steel, or any combination thereof.

All numerical values provided are approximate; they can be changed to adapt to other magazines or round types and or calibers.

The loader may also be constructed to include insertable or movable spacer(s) to accommodate magazines of different dimensions.

Various other spring types or other mechanical means or methods may replace the compression spring mentioned; such can be an extension spring, a torsion-spring, a flat steel spring, flexible rubber, or a flexible polymer spring member. For example, a torsion spring fixed in the loader may replace the compression spring with one arm of the spring on the body of the loader and the second arm on the magazine pusher element or on the magazine, if no pusher element is used; where the spring is tensioned or charged when the loader is pushed down on the magazine, and can lift the loader up when the force is lessened; in this arrangement the magazine pusher may be arranged to rotate about an axes.

Alternatively, the magazine pusher element 20 and 70 or other may have a slot (rather than rib 30 or 82 shown) and the body 12 and 62 or other may have a rib (rather than slot 26 or 76 shown) sized and shaped to accept the slot in a mating manner so that the movement of the pusher element is guided by the mating slot and rib.

Spring holder 96 of FIG. 4 can be made differently, like being a hole with a smaller diameter than the external diameter of the spring, where the spring is forced into.

Accordingly, the scope should be determined, not by the embodiments illustrated, but by the appended claims and their legal equivalents.

We claim:

1. A magazine loader for facilitating the loading of rounds into a predetermined firearm magazine having an open upper end and which holds one or more columns of rounds therein and urges said rounds to, and feeds said rounds from, said open end of said magazine, said loader comprising:

a. a substantially hollow body comprising a housing having a substantially rectangular bottom opening that is sized and shaped to fit onto said open end of said magazine, b. a tooth or plunger in said body, c. said tooth or plunger being sized and positioned, so that when said loader is fitted onto said magazine, said tooth or plunger does not engage any round or follower in said magazine, and when said loader is forced down onto said magazine, said tooth or plunger pushes down a topmost round or follower in said magazine a sufficient distance to insert a new round, rim first, until it engages said tooth or plunger, and d. a spring in said body, e. said spring having first and second ends, f. said first end of said spring joined to said body, g. said spring being positioned, shaped, and sized so that when said body is fitted onto said magazine, said second end of said spring engages said magazine and when said loader is forced down onto said magazine, said magazine pushes said second end of said spring up to compress said spring and thereby urge said loader away from said magazine, h. said second end of said spring being free of rigid or fixed joinder to any component, i. whereby said loader can be fitted onto said magazine and when forced down said plunger pushes a topmost round or follower down into said magazine so that a user may insert a round partially into said magazine, whereafter said user may reduce force on said body to allow said spring to lift said loader up so that said plunger is cleared from said magazine, whereupon said round can be forced rearwardly to a final position in said magazine, so that new rounds can be loaded into said magazine without exerting finger force to push existing rounds or a follower in said magazine down.

2. The magazine loader of claim 1 wherein said tooth or plunger is an elongated element having an upper end attached to an inside upper part of said body and a free lower end.

3. The magazine loader of claim 1 wherein said spring is positioned and shaped so that said second end thereof engages a lip on said open end of said magazine.

4. The magazine loader of claim 1 wherein said spring is positioned, shaped, and sized so that said second end thereof engages a ledge on an outside of said magazine.

5. The magazine loader of claim 1 wherein said spring is a compression spring and said first end of said compression spring is affixed to a post or stub extending down from an upper end of said body.

6. The magazine loader of claim 1 wherein said spring is a compression spring and said first end of said compression spring is affixed to a post or stub extending down from an inside upper part of said body and said tooth or plunger is an elongated element having an upper end attached to an inside upper part of said body and a free lower end.

7. The magazine loader of claim 1 wherein said body has an upper end to which said tooth or plunger and spring are affixed, a plurality of sides extending up from said bottom opening to said upper end, and an upper opening that is slanted with respect to said upper end and that extends to said upper end.

8. In a magazine loader of the type for facilitating the loading of rounds into a predetermined firearm magazine having an open upper end and which holds one or more columns of rounds therein and urges said rounds to, and feeds said rounds from, said open end of said magazine, where said loader comprises:

a. a substantially hollow body having a substantially rectangular bottom opening that is sized and shaped to fit onto said open end of said magazine, said body containing a tooth or plunger, b. said tooth or plunger being sized and positioned, so that when said loader is fitted onto said magazine, said tooth or plunger does not engage any round or a follower in said magazine, and when said loader is forced down onto said magazine, said tooth or plunger pushes down a topmost round or follower in said magazine a sufficient distance to insert a new round, rim first, until it engages said tooth or plunger, and c. said body containing a magazine pusher element, and d. a spring positioned between said body and said magazine pusher element and having an upper end fixedly joined to said body and a lower end fixedly joined to said magazine pusher element, where said magazine pusher element and said spring arranged so that when said body is fitted onto said magazine, said magazine pusher element engages said magazine and when said loader is forced down onto said magazine, said magazine pushes said magazine pusher element up to compress said spring and thereby urge said loader away from said magazine, characterized in that:

e. said magazine pusher element is free of rigid or fixed joinder to any component other than said spring so that said magazine pusher element can move vertically in said body, f. whereby said loader can be fitted onto said magazine so that when forced down onto said magazine, said plunger pushes a topmost round or follower down into said magazine so that a user may insert a round partially into said magazine, whereafter said user may reduce force on said body to allow said spring to lift said loader up so that said plunger is cleared from said magazine, whereupon said round can be forced rearwardly to a final position in said magazine, so that new rounds can be loaded into said magazine without exerting finger force to push existing rounds or follower in said magazine down.

9. The magazine loader of claim 8 wherein said magazine pusher element has a guide means comprising at least one projecting rib and said body comprises a slot sized and shaped to accept said projecting rib in a mating manner so that said movement of said pusher is guided by said mating rib and slot and so that said magazine pusher is prevented from rotating or moving in any direction except vertically.

10. The magazine loader of claim 8 wherein said spring is a compression spring and said magazine pusher element has a concave recess bottom.

11. The magazine loader of claim 8 wherein said magazine pusher element is positioned and shaped to engage a lip or ledge on said open end of said magazine.

* * * * *